United States Patent [19]

Versage

[11] Patent Number: 4,907,826

[45] Date of Patent: Mar. 13, 1990

[54] BUSINESS ORIENTED GREETING CARDS

[76] Inventor: Corinne Versage, 3 Rosbury La., Bridgeport, Conn. 06606

[21] Appl. No.: 906,090

[22] Filed: Sep. 11, 1986

[51] Int. Cl.[4] ..... H09F 1/04; H09F 1/00; B42D 15/00; B42D 15/04

[52] U.S. Cl. ..... 283/56; 283/117; 229/92.8; 40/124.1

[58] Field of Search ..... 283/1 R, 51, 52, 86, 283/56.1 R; 229/92.8; 446/147; 40/539

[56] References Cited

U.S. PATENT DOCUMENTS

| | | | |
|---|---|---|---|
| 1,434,009 | 10/1922 | Harris | 229/92.8 |
| 2,720,833 | 10/1955 | Lindon | 229/92.8 |
| 3,487,573 | 1/1970 | Slovacek | 40/124.1 |
| 4,070,778 | 1/1978 | Mahler et al. | D19/1 |
| 4,589,590 | 5/1986 | McGuire | 229/92.8 |
| 4,613,157 | 9/1986 | Drabish | 283/1 R |
| 4,622,768 | 11/1986 | Moreau | 229/92.8 |

OTHER PUBLICATIONS

Foldable Greeting Card with Equal Pages.
Foldable Greeting Card of Biorkman Bros.

*Primary Examiner*—Douglas D. Watts
*Assistant Examiner*—Paul M. Heyrana
*Attorney, Agent, or Firm*—Richard A. Craig

[57] ABSTRACT

A greeting card is an article of manufacture comprising a piece of card stock having a message imprinted thereon. The message is uniquely appropriate for being sent or given by one person (or a plurality of persons) to another person who is related to the sender(s) in a professional or business way. The message may be split into a plurality of parts, so that the recipient does not see the entirety of the message at once. The message may be a play on words.

2 Claims, 2 Drawing Sheets

BUSINESS ORIENTED GREETING CARDS

BACKGROUND OF THE INVENTION

This invention relates to greeting cards and more particularly to a greeting card as a means of saying "I care", "Thank you", or to express words of encouragement or motivation or acknowledgment to a person related to the sender in a professional or business or workplace way.

The following U.S. patents may be of interest to the reader:

| U.S. Pat. No. | Date | Inventor |
|---|---|---|
| Des. 259,572 | June 16, 1981 | Renaud |
| 2,642,182 | June 16, 1953 | Baynes |
| 3,762,630 | October 2, 1971 | Braznell |
| 3,986,283 | October 19, 1976 | Pelaez |
| 4,070,778 | January 31, 1978 | Mahler et al. |
| 4,404,764 | September 20, 1983 | Wills et al. |
| 4,559,583 | December 17, 1985 | Ku |

PATENTABILITY

Renaud discloses an ornamental design for a greeting card, but no message is suggested.

Baynes teaches the combination of a French-folded greeting card and an envelope of greater dimension than the card and interleaved between the two sheets of the card. This combination is held together by a small corner member carrying the price of the card.

Braznell discloses another combined card and mailer.

Pelaez teaches a novelty post card that is injection molded of plastic material.

Mahler et al. discloses a greeting card of two sections.

Wills et al. discloses a greeting card that carries a message in words and also in tactile form (Braille) for unsighted people.

Ku teaches a greeting card with a blinking light apparatus.

These prior patents do not teach or suggest a greeting card with a message of a professional or business character.

It is an important object of the invention to provide a greeting card for conveying a message of caring to a person related to the sender(s) in a professional or business way.

It is an additional object to provide a line of such greeting cards.

Further objects and advantages will become evident hereinafter.

SUMMARY OF THE INVENTION

A greeting card according to the invention is an article of manufacture comprising a piece of card stock having a message imprinted thereon, the message being uniquely appropriate for being conveyed by one person (or a plurality of persons) to another person who is related to the conveyor(s) in a professional or business way. The message is advantageously split into a plurality of parts so that the recipient does not see the entirety of the message at once. The message may be a play on words.

DESCRIPTION OF THE INVENTION

Figure 1:
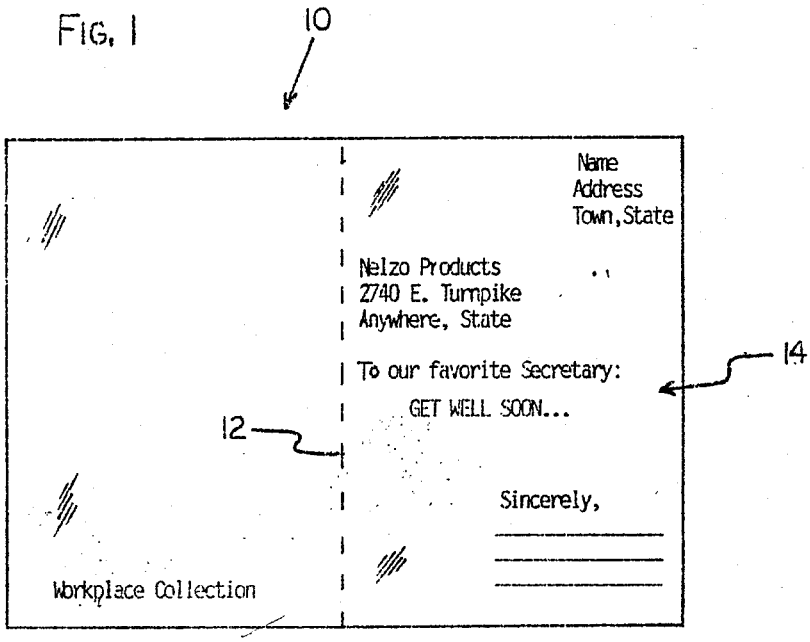
FIG. 1 is a view of the outside of a first greeting card embodying the invention, the card being shown flattened to show the front and back.
Figure 2:
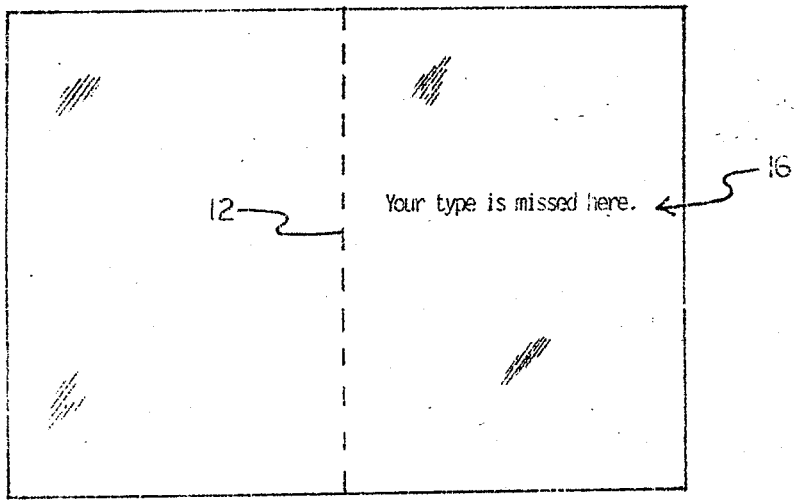
FIG. 2 is a view of the inside of the card of FIG. 1, again in flattened condition.

FIGS. 1 and 2 show as a first example of the invention a greeting card 10. Card 10 is an article of manufacture comprising a rectangular piece of card stock having a fold line 12 bisecting the same, to provide card 10, when folded on line 12 with an outside and an inside, the outside being shown in FIG. 1 and the inside in FIG. 2.

Card 10 may be thought of as having four pages, FIG. 1 showing page 1 to the right of line 12 and page 4 to the left of line 12, and FIG. 2 showing page 2 to the left of line 12 and page 3 to the right of line 12.

Card 10 bears its message on pages 1 and 3. The first part of the message (on page 1) is shown at 14 and the second part of the message (on page 3) at 16.

The first part 14 of the message is TO OUR FAVORITE SECRETARY: GET WELL SOON and the second part 16 of the message is YOUR TYPE IS MISSED AROUND HERE.

Card 10 is suitable for an ill secretary and is uniquely appropriate for being sent or given in a situation arising out of a workplace environment.

Figure 3:
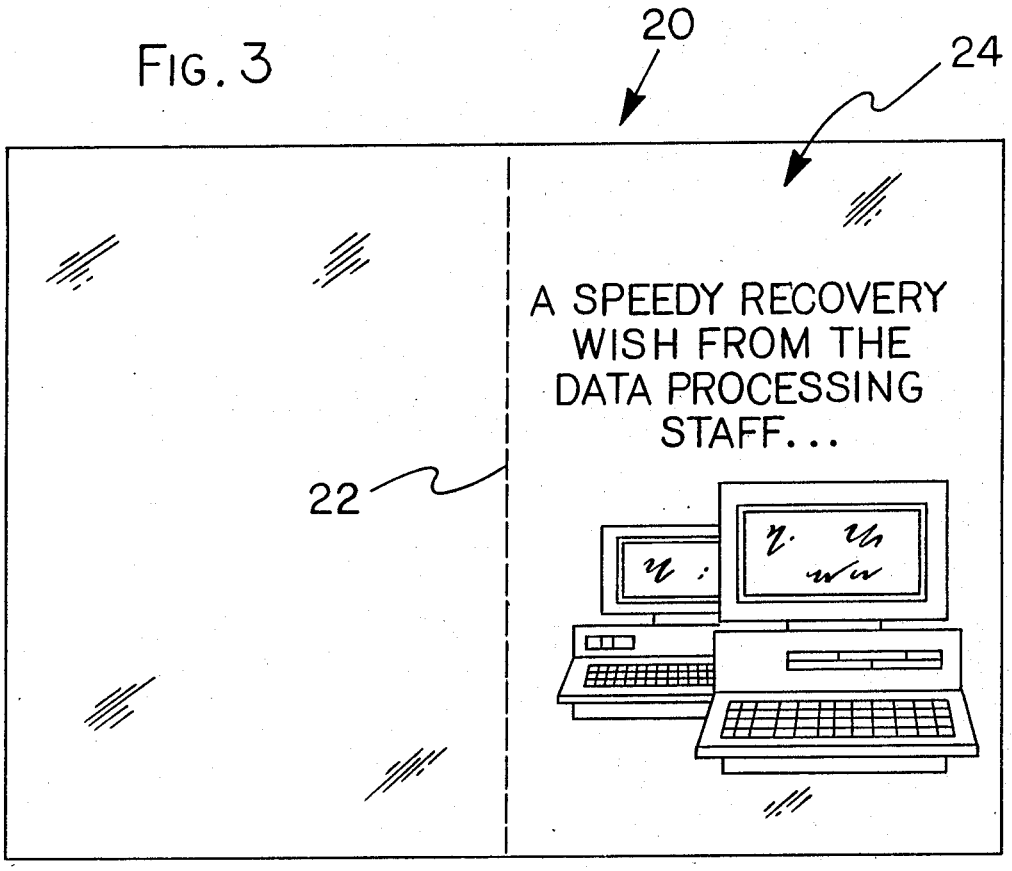
FIGS. 3 and 4 are views similar to FIGS. 1 and 2, respectively, but showing a second greeting card embodying the invention.
Figure 4:
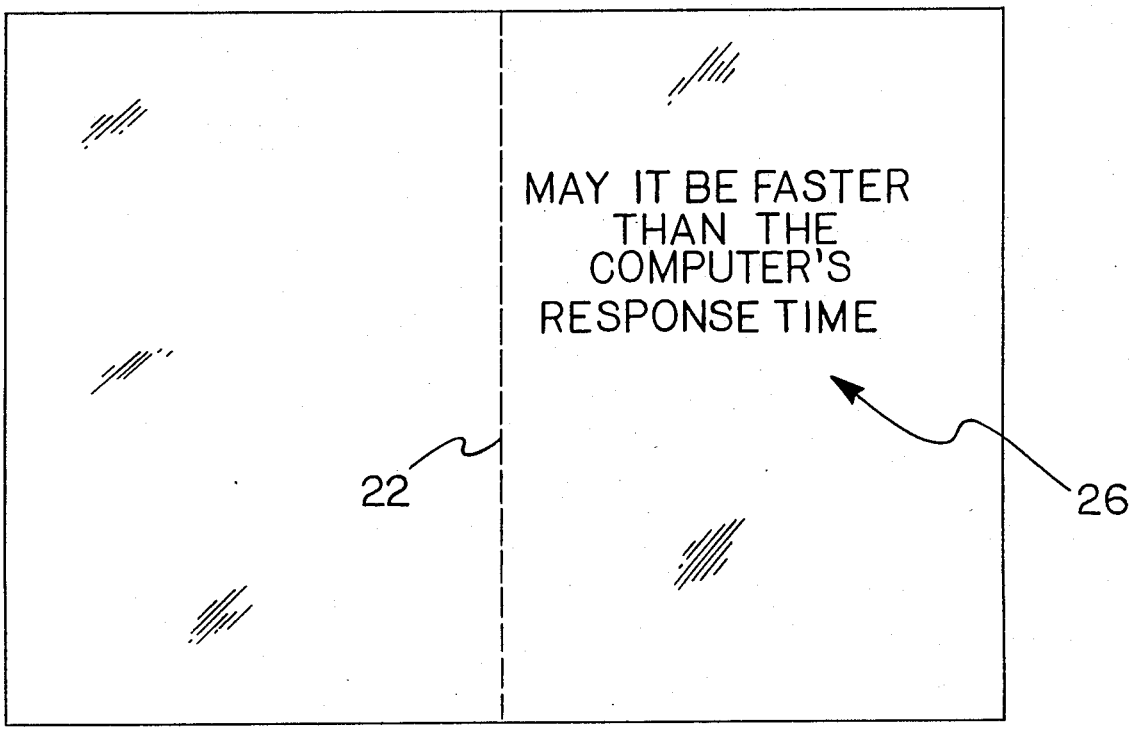

FIGS. 3 and 4 show as a second example of the invention a greeting card 20. Card 20 is an article of manufacture comprising a rectangular piece of card stock having a fold line 22 bisecting the same, to provide card 20, when folded on line 22 with an outside and an inside, the outside being shown in FIG. 3 and the inside in FIG. 4.

Card 20 may be thought of as having four pages, FIG. 3 showing page 1 to the right of line 22 and page 4 to the left of line 22, and FIG. 2 showing page 2 to the left of line 22 and page 3 to the right of line 22.

Card 20 bears its message on pages 1 and 3. The first part of the message (on page 1) is shown at 24 and the second part of the message (on page 3) at 26.

The first part of the message 24 is A SPEEDY RECOVERY WISH FROM THE DATA PROCESSING STAFF and the second part 26 of the message is MAY IT BE FASTER THAN THE COMPUTER'S RESPONSE TIME.

Card 20 is suitable for an ill data processing person and is uniquely appropriate for being sent or given in a situation arising out of a workplace environment.

In the case of each of cards 10 and 20, the message is a play on words and the recipient will see only the first part of the message upon initial viewing of the card and will see the second part of the message upon opening the card.

Two examples of other messages are as follows, in each case the thrust of the message being obvious: "YOUR WORK AS A CHEMIST HAS BEEN SUCCESSFUL BECAUSE . . . YOU FIND THE SOLUTION TO EVERYTHING"; and "BEING THE TOWN'S FAVORITE SHOEMAKER HAS TO BE AN . . . UPLIFTING EXPERIENCE."

Further examples of greeting cards embodying the invention are endless.

In every case, the card will have a professional, neat, clean look and will convey a personal, caring message that pertains to a workplace or business establishment only. Among other types of messages, the basic message may be "GET WELL", or "THANK YOU", or express words of encouragement or motivation or acknowledgment.

The invention well attains the stated objects and advantages and others.

The disclosed details are exemplary and are not to be taken as limitations on the invention except as those details may be included in the appended claims.

What is claimed is:

1. As an article of manufacture, a greeting card comprising a piece of card stock and a unitary message imprinted thereon, said message being a pun uniquely appropriate for being conveyed by a sending entity to a person who is related to the sending entity in a professional or business way, wherein said piece of card stock has a fold line providing said card with a plurality of pages, said message being partly on one of said pages and partly on another of said pages and wherein said message is visible in part but not in its entirety when said card is folded on said fold line, and wherein the part of said message which reveals said pun is visible only when said card is unfolded on said fold line and is completely invisible when said card is folded on said fold line.

2. A greeting card according to claim 1 wherein said pages are substantially the same size.

* * * * *